United States Patent [19]

Hoffmann et al.

[11] 4,444,118

[45] Apr. 24, 1984

[54] PROJECTILE, PARTICULARLY ARMOR-PIERCING SHELL

[75] Inventors: Dietrich Hoffmann; Oswin Günther, both of Schramberg, Fed. Rep. of Germany

[73] Assignee: Mauser-Werke Oberndorf GmbH, Fed. Rep. of Germany

[21] Appl. No.: 237,907

[22] Filed: Feb. 25, 1981

[30] Foreign Application Priority Data

Mar. 14, 1980 [DE] Fed. Rep. of Germany ..... 3009774

[51] Int. Cl.[3] ..... F42B 11/06

[52] U.S. Cl. ..... 102/518; 102/364

[58] Field of Search ..... 102/517–519, 102/288, 286, 364, 495

[56] References Cited

U.S. PATENT DOCUMENTS

| | | | |
|---|---|---|---|
| 37,661 | 2/1863 | Gerardin | 102/495 |
| 694,295 | 2/1902 | Maxim | 102/288 |
| 740,849 | 10/1903 | Groff | 102/519 |
| 1,010,430 | 12/1911 | Jandrier et al. | 102/288 |
| 3,028,808 | 4/1962 | Porter et al. | 102/364 |
| 3,276,379 | 10/1966 | Dallett | 102/288 |
| 3,302,570 | 2/1967 | Marquardt | 102/364 |
| 3,861,311 | 1/1975 | Bilsbury | 102/518 |

*Primary Examiner*—Harold J. Tudor

*Attorney, Agent, or Firm*—McGlew and Tuttle

[57] ABSTRACT

A projectile, comprises, an outer metallic hollow shell body and a shell core (for example hard metal or heavy metal) disposed in the body having a first cylindrical front portion and a rear portion having a lesser diameter than the front portion. A pyrophoric material liner is disposed on and secured to the rear portion and it is dimensioned such that its outer surface does not project outwardly beyond the surface of the front portion. The liner advantageously comprises a hollow cylinder or a plurality of hollow cylinders, or it may comprise individual strips arranged circumferentially around the rear portion. It is made of pyrophoric material which may comprise a single material or a plurality of different materials of different nature. It is secured to the shell core by press-fitting, cementing or screwing.

2 Claims, 5 Drawing Figures

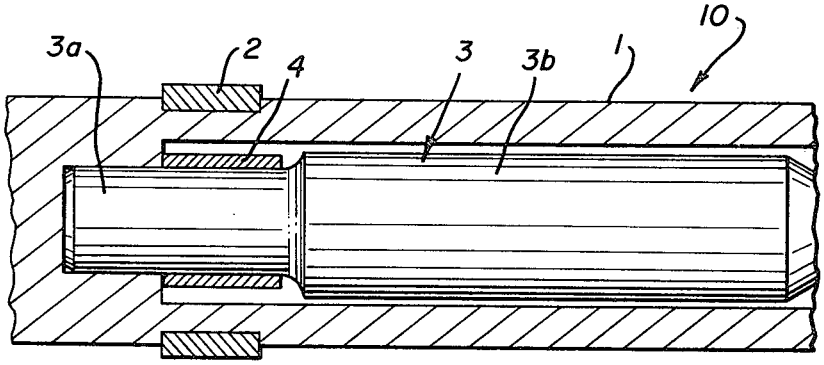
10
3a
2
4
3
3b
1

PROJECTILE, PARTICULARLY ARMOR-PIERCING SHELL

FIELD AND BACKGROUND OF THE INVENTION

This invention relates to the construction of projectiles in general and, in particular, to a new and useful armor-piercing projectile which comprises a shell body having a core therein with a front diameter which is larger than a rear diameter portion and includes a liner disposed around the rear diameter portion made of pyrophoric material which is dimensioned so that it does not project beyond the front portion of the shell body.

While, on the battlefield, so called soft targets are fought with explosive or splinter shells as a rule, hard core shells are used for armored targets. In order to increase their penetrating power such a core may also be used as a subcaliber projectile in a sabot projectile, whereby the core is carried down the gun bore by a sabot.

It is further known to provide armor-piercing shells with a pyrophoric lining in order to set the interior of the armored target afire after penetration. Such a lining in armor-piercing shells is usually provided at the tip of the shell core or at the rear thereof.

Certain bounds are set to a successful use of such shells. These bounds substantially relate to the concept or design and they necessarily follow from the fact that the capability of shells provided with the pyrophoric lining of producing an incendiary effect over the entire range of impact angles is very limited, particularly in the flat angle range.

The use of armor-piercing shells having a core of depleted uranium, which itself has intrinsic pyrophoric properties is controversial, because of their radioactivity and toxicity and therefor is left out of consideration. That's why the present invention is of special interest mainly for such shell cores, which itself have no sufficient pyrophoric properties.

SUMMARY OF THE INVENTION

In view of these given bounds in the concept and design, as well as the material of prior art armor-piercing shells, the present invention is directed to a projectile having its pyrophoric lining arranged on the shell core so that, while particularly taking into account the parameters of impact angle, target thickness, and multiplicity, the core is capable of penetrating the target over the entire range of impact angles and to securely produce an incendiary effect in the interior.

The present invention provides a projectile in which the diameter of the rear portion of the shell core is reduced relative to the front portion thereof so that a radial extension of a lining, made of pyrophoric material and disposed on and firmly secured to the reduced diameter rear portion, is equal to, or smaller than, the outer diameter of the front portion of the shell core.

The invention offers a number of advantages. The most important advantage is that, with the shell having the pyrophoric lining provided on the rear portion of the shell core, it is ensured that the shell core will not only pierce the target over the entire range of penetration, but it will also have the incendiary effect in the interior, since the lining cannot be stripped off the core during the penetration (not even at acute angles of impact).

Contrary to the arrangement known per se, of the pyrophoric material in front of the shell core, the inventive arrangement prevents the pyrophoric material from being spattered aside, primarily if the impact angle is flat.

Another substantial advantage is that the geometry of the pyrophoric bodies may be varied, without any change in the idea underlying the invention. It is thus easily possible to adapt to technical combat conditions, for example. It is a further advantage that, if needed, a multi-part pyrophoric body may be used having its parts made of materials of mutually different pyrophoric properties.

Accordingly, it is an object of the present invention to provide a projectile which comprises an outer metallic hollow shell body with a hard metal shell core disposed in the body which has a first cylindrical front portion and a rear portion of less diameter than the front portion and includes a pyrophoric material liner disposed on and secured to the rear portion and having an outer surface which does not project outwardly beyond the surface of the first cylindrical front portion.

A further object of the invention is to provide a projectile, particularly an armor-piercing shell, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

In the Drawing:

The FIG. 1 of the drawing is a partial sectional view of a projectile, constructed in accordance with the present invention.

The FIG. 2 is a partial sectional view of a projectile with sequentially cylinders in the axial direction.

The FIG. 3 is a partial sectional view of a projectile with cylinders in the radial direction.

The FIG. 4 is a partial sectional view of a projectile with strips in the axial direction.

The FIG. 5 is a sectional view of V—V in FIG. 4.

DESCRIPTION OF THE PREFERRED EMBODIMENT

Referring to the drawing in particular, the invention embodied therein, comprises, a projectile, generally designated 10, which comprises an armor-piercing shell and includes an outer metallic shell body 1.

The metallic shell body 1 is joined in the axial direction to a ballistic ogive. The body 1 is pressfitted in a cartridge (not shown) in which the priming and propelling charge is received. For satisfactory guidance and sealing, in or relative to the barrel, shell body 1 is provided with a rotating band 2.

A hard metal shell core 3 of a tungsten carbide, for example, is concentrically received centrally of shell body 1. A rear portion 3*a* of shell core 3 has a markedly smaller diameter than the other portions thereof, and this rear portion is fitted into the shell body 1. At least one body, such as a hollow cylinder 4 of a pyrophoric material, (zirkonium, mischmetal, hafnium, etc.,) is secured to the rear portion 3*a* of shell core 3 by press-fitting, cementing or screwing.

In order to securely prevent pyrophoric body 4 from being stripped from shell core 3 during penetration of the target, for example, if the angle of impact is acute, rear portion 3*a* must be slender to such an extent that the outer diameter of the pyrophoric hollow cylindrical body 4, for example, does not exceed the outer diameter of a core portion 3*b* without a reduced diameter.

Without departing from the scope of the invention, a plurality of such hollow cylinders 4 may be provided on the reduced diameter rear portion 3*a* of shell core 3. In this connection, it is irrelevant whether the cylinders are secured to rear portion 3*a* sequentially in the axial direction 4*a*, or over one another in the radial direction 4*b*, as long as their outer diameters meet the requirement of not exceeding the outer diameter of the other portions of shell core 3.

The pyrophoric lining 4 may also be designed as a plurality of strips 4*c* which are disposed on reduced diameter rear portion 3*a* one after the other in the axial direction and/or distributed over the circumference. This embodiment offers the possibility of using strips or cylinders 4 having different pyrophoric properties 4*a* relative to each other. Advantageously, the pyrophoric body or bodies 4, 4*a*, 4*b*, 4*c* are secured to rear portion 3*a* by press-fitting, cementing or screwing.

While a specific embodiment of the invention has been shown and described in detail to illustrate the application of the principles of the invention, it will be understood that the invention may be embodied otherwise without departing from such principles.

We claim:

1. An armor piercing projectile, comprising: a ballistic hood; a shell (1) extending from said hood in an axial direction; a core (3) centrically positioned in said shell and having a head portion (36) with a large diameter and a rear portion (3*a*) with a diameter smaller than said large diameter; and a liner of pyrophoric material having a radial extent which is not greater than said large diameter of said head portion (3*b*) of said core (3), said liner of pyrophoric material being composed of a plurality of hollow cylindrical bodies (4*b*) which are provided on said rear portion (3*a*) of said core and arranged in radial superposition, said liner of pyrophoric material being firmly connected to the rear portion by at least one of a press-fit, a cementing thereto and a screwed connection thereto, and said plurality of cylindrical bodies (4*b*) being formed of pyrophoric materials which are of different characteristics.

2. An armor piercing projectile, comprising: a ballistic hood; a shell (1) extending from said hood in an axial direction; a core (3) centrically positioned in said shell and having a head portion (3*b*) with a large diameter and a rear portion (3*a*) with a diameter smaller than said large diameter; and a liner of pyrophoric material having a radial extent which is not greater than said large diameter of said head portion (3*b*) of said core (3), said liner of pyrophoric material being composed of a plurality of hollow cylindrical bodies (4*a*) which are provided on said rear portion (3*a*) of said core and arranged in axial superposition, said liner of pyrophoric material being firmly connected to the rear portion by at least one of a press-fit, a cementing thereto and a screwed connection thereto, and said plurality of cylindrical bodies (4*a*) being formed of pyrophoric materials which are of different characteristics.

* * * * *